United States Patent [19]

Rhodes, Jr.

[11] 4,307,922

[45] Dec. 29, 1981

[54] MOVABLE STORAGE SYSTEM

[75] Inventor: Howard A. Rhodes, Jr., Annapolis, Md.

[73] Assignee: Reflector-Hardware Corporation, Melrose Park, Ill.

[21] Appl. No.: 130,075

[22] Filed: Mar. 13, 1980

[51] Int. Cl.[3] ..... A47B 53/00; A47B 87/00

[52] U.S. Cl. ..... 312/198; 312/201; 211/1.5; 104/288; 104/295

[58] Field of Search ..... 312/198, 200, 201, 199; 104/288, 295, 299, 301; 211/1.5

[56] References Cited

U.S. PATENT DOCUMENTS

| | | | |
|---|---|---|---|
| 3,575,298 | 4/1971 | Ruoss | 211/1.5 |
| 3,640,595 | 2/1972 | Staller et al. | 312/198 |
| 3,829,189 | 8/1974 | Staller | 312/198 |
| 3,890,903 | 6/1975 | Showell | 312/198 |
| 3,957,322 | 5/1976 | Mastronardi et al. | 312/198 |
| 3,957,323 | 5/1976 | Tucker et al. | 312/198 |
| 4,017,131 | 4/1977 | Camenisch | 312/198 |
| 4,033,649 | 7/1977 | Naito et al. | 312/198 |
| 4,039,040 | 8/1977 | Spears et al. | 312/201 |
| 4,119,376 | 10/1978 | Moyer | 312/198 |

*Primary Examiner*—Victor N. Sakran

*Attorney, Agent, or Firm*—Dressler, Goldsmith, Shore, Sutker & Milnamow, Ltd.

[57] ABSTRACT

A movable storage system having a plurality of storage units disposed side-by-side and movable relative to each other to selectively open access paths between selected pairs of units. In response to operation of enabling and selection switches, a new aisle is identified, and the necessary units are moved to open the new aisle in a determined time sequence.

17 Claims, 9 Drawing Figures

FIG. 1
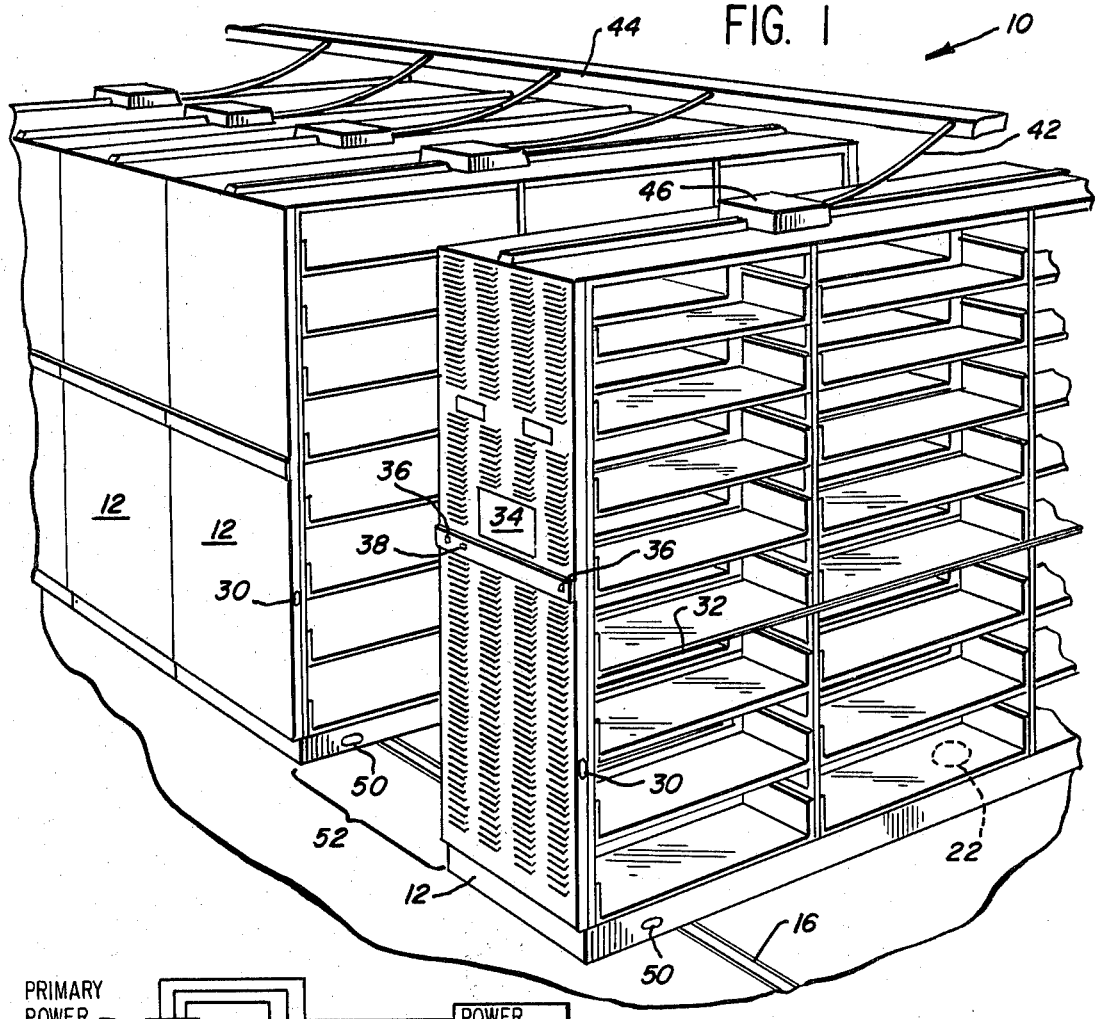
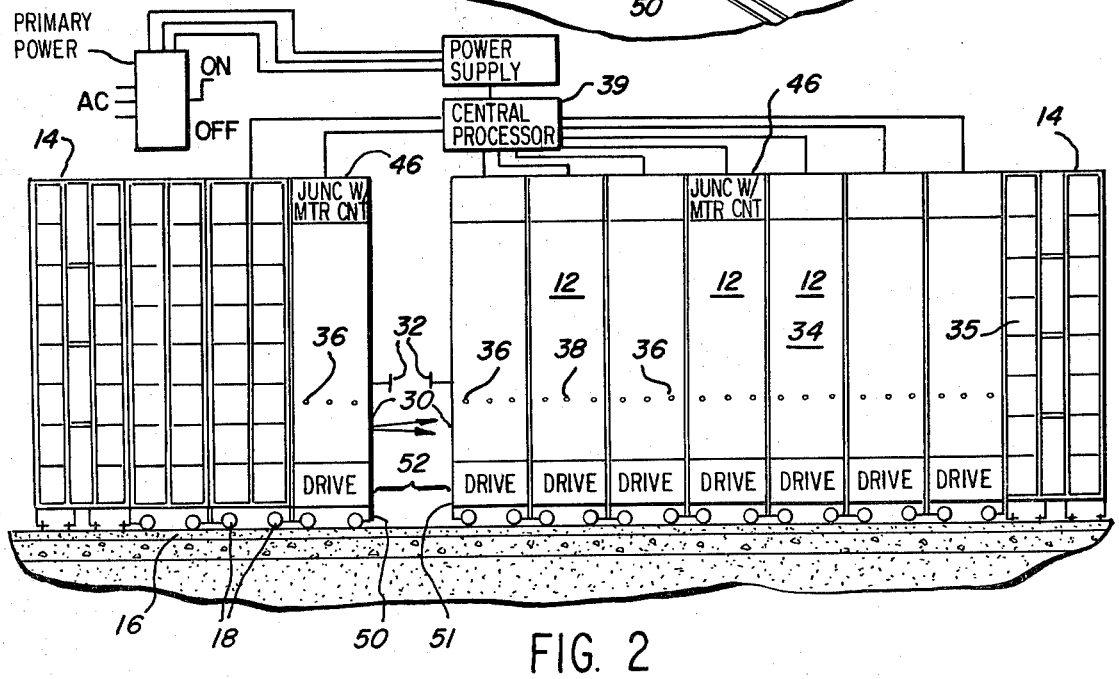
FIG. 2

MOVABLE STORAGE SYSTEM

TECHNICAL FIELD OF INVENTION

The present invention relates to storage systems, and more particularly, to storage systems comprised of a plurality of storage units selectably movable to provide an access path between a selected pair of storage units.

BACKGROUND OF THE INVENTION

In order to effectively and efficiently make use of available storage space, storage systems comprised of a number of movable storage units such as bookshelves are often utilized. In these systems access is typically provided to less than all of the storage units at any one time. Thus, the storage units are movable in order to provide access to different selected ones of the units.

Such storage systems are disclosed, for example, in Ruoss U.S. Pat. No. 3,575,298; Staller et al. U.S. Pat. No. 3,640,595; Mastronardi et al. U.S. Pat. No. 3,957,322; Tucker et al. U.S. Pat. No. 3,957,323; and Naito et al. U.S. Pat. No. 4,033,649. Each of these patents discloses movable storage apparatus in which various storage units are reciprocally movable to selectively separate adjacent storage units to establish an aisle or access path between those units. The units may be moved to selectively provide access between different pairs of spaced apart units.

In these apparatus, as distinguished from stationary shelving, access is typically provided only between one pair of units. The remaining units abut or are positioned immediately next to the next adjacent units. As a result, access to those storage units is precluded. Thus, in order to obtain access to a pair of units other than the pair which have previously been separated to provide an access path, selected units are moved to close the previously separated units and to separate a different pair and provide access thereto.

As is shown in the above cited patents, such apparatus incorporate one or more electrical drive motors for moving the units to obtain separation between two selected storage units. This is initiated in response to operation of manually operated switches. In order to achieve this type of operation, it is necessary to determine when units approach the next adjacent unit in order to terminate movement thereof and ultimately stop all the movement when separation between the selected units has been achieved.

In these systems, the necessary movement and control requires large numbers of switches and some very complicated wiring and relay controls.

For example, in the Staller et al. U.S. Pat. No. 3,640,595, each of the units incorporates an electric motor, which when energized, causes the unit with which it is associated to move in one of two directions. In order to operate the motor in the proper direction, a large number of hard wired circuits and control switches are provided and very complicated wiring systems are utilized. As a result, as each unit is moved in a selected direction, switches are sensed and operated in order to allow the units to be moved, and to terminate movement and de-energize the motor for that unit as it approaches an adjacent unit.

If it is desired to move a unit towards another unit from which it is separated, a limit switch is closed and a circuit completed through that closed switch to a drive motor. At the same time, other switches must be operated to insure the proper direction of operation. As the movement of that unit begins, the circuitry must preclude energization of the motor in the wrong direction and, furthermore, interconnects with the the next adjacent unit so it may be operated in response to the closure of the appropriate switches resulting from the separation of the first unit from the second to be moved. As each unit approaches the adjacent unit in the direction of movement, limit switches in the motor circuit are opened in order to de-energize the motor for that unit.

Thus, a large number of mechanical switches are required in the motor circuit, and the large number of relays used adds additional expense and complexity to the control system for that unit and severely limits the flexibility of operation because of the extensive wiring and switching which is required.

Tucker et al., U.S. Pat. No. 3,957,323 is quite similar to the previously discussed Staller et al. patent in that a large number of switches and relays are utilized in the motor circuits for controlling and operating each unit in the necessary direction by energizing and de-energizing the motor at the proper time. In the very complicated Tucker system there is extensive use of relay circuits which are operated in order to initiate movement, to control other relay circuits, and to return the control circuit to a quiescent or idle state after movement of the shelves and storage units has been terminated.

The Naito et al. U.S. Pat. No. 4,033,649, discloses another highly complex electrical wiring circuit in which a number of selection switches are connected in the various motor circuits to initiate operation of the motors and move the various storage units from one position to another. The complexity of the disclosed control circuits, as shown in the patent drawing, including the large number of switches and relays required, presents the same problem as discussed above in terms of limited flexibility, operational problems, and reliability.

In each of the patents discussed above, movement of the various units is initiated one after the other in response to switches in the various units being actuated by a gap created between that unit and the next adjacent one as a result of the movement of one of the units. The storage apparatus disclosed in Ruoss U.S. Pat. No. 3,575,298 and Mastronardi et al. U.S. Pat. No. 3,957,322 are similar in that extensive and complex wiring systems with numerous switches and relays are provided. These switches are necessary in order to effect the desired movement of different storage units in different directions as a function of the existing position of the units and their desired final position.

The patents briefly discussed above are typical of the techniques disclosed in the prior art for attempting to selectively move and shift storage units such as movable bookshelves from one position in which a first pair of units are separated to another position in which another pair of units are separated to selectively provide access to different portions of the storage assembly. The complexity of such systems and the necessity for providing extensive and complicated circuitry limits the flexibility and reliability of those systems, and requires extensive amounts of high voltage wiring in order to selectively control operation of one or more reversible motors. All of this tends to inhibit the use of such systems and increase their cost.

SUMMARY OF THE INVENTION

In accordance with the present invention there is provided a movable storage system comprised of a plurality of storage units disposed side-by-side with individual ones of the units movable towards and away from the next adjacent units to selectively create open access paths or aisles between a selected pair of the units.

The movable storage system incorporating the present invention produces the necessary and desired movement of the storage units to selectively open access paths to selected units while simultaneously eliminating the multiplicity of switches, relays and complex wiring systems. At the same time, the storage system incorporating the present invention provides desired flexibility to enable operation of the system in accordance with various selected conditions.

Thus, the movable storage system incorporating the present invention utilizes a plurality of storage units such as double-sided bookshelves reciprocally movable along a path towards and away from adjacent shelves by means of a drive motor connected to drive wheels on which each storage unit is supported. The drive motor may be energized to move the shelves by turning the drive wheels in either of two directions as a function of the location of an existing access aisle between two storage units and the access aisle desired to be opened between two other storage units.

In accordance with the present invention, when it is desired to open a new access aisle, a pair of switches on the storage units on either side of an existing aisle must be actuated simultaneously. Simultaneous actuation forces the operator to reach across the open access aisle so the operator can observe the aisle and determine that the aisle is free of obstructions. After the simultaneous actuation of the enabling or reset switches, a selection or run switch on a storage unit adjacent to the location of the access aisle or path to be formed is actuated.

In response to actuation of the selection switch, that storage unit which is adjacent to the existing open passage and between that passage and the new passage is the first unit to be moved, the drive motor for that unit is energized to move the unit in a direction to close the existing passage, i.e., towards the other storage unit defining the existing passage. The moving unit advances until such time as it reaches a position immediately adjacent the other storage unit.

A specified time after movement of the first storage unit is initiated, the drive motor for the next storage unit to be moved is energized to initiate movement of that unit in the same direction. In this way, movement of each of the storage units to be moved is initiated sequentially in a pre-selected time sequence after actuation of the selection switch.

As each unit approaches the next adjacent unit, proximity sensors are actuated. In response to actuation of these sensors, the drive motor for that unit is de-energized and its movement is terminated. Thus, in operation, movement of each of the units to be moved is initiated in a timed sequence after actuation of a selection switch, which is operative only if the proper enabling switches have previously been actuated. Movement of the units is terminated in response to sensors detecting proximity of an adjacent unit. A plurality of safety sensors are also provided between adjacent pairs of storage units to effect a termination of all shelf and storage unit movement if any object is detected within the gap between adjacent units.

In order to effectuate the desired operation reliably and with the highest degree of simplicity, the system of the present invention incorporates a microprocessor control system which operates to detect the status of all of the switches within the system and to produce the control signals necessary to effect the desired operation. The control system scans the status of the various proximity sensors and determines from the status of those sensors the location of the open aisle or access passage since the proximity sensors assume one state when there is no immediately adjacent storage unit and assume another state when there is a storage unit immediately adjacent thereto.

When the location of the open aisle has been identified, in terms of the identity of the storage units on either side thereof, the system precludes any operation unless and until the two enabling switches on the storage units on either side of the access passage are actuated simultaneously. In this regard, the control system continuously and repetitively scans these two switches until such time as both are closed.

In response to the closure of both of the enabling switches, the system scans each of the selection switches sequentially until such time as it senses a change in state in one of the switches which defines the new access passage to be opened.

Upon identifying the selection switch which has been actuated, the control system determines the position of the new access aisle relative to the old access aisle, identifies the storage units which must be moved and the direction in which such storage units must be moved. Drive motor enabling signals are then produced sequentially at selected time intervals to sequentially energize each of the drive motors associated with the storage units to be moved. The first drive motor energized is that one for the storage unit adjacent to the existing open aisle. The drive motor of the next adjacent unit is energized thereafter as are the other unit drive motors, in order and sequentially.

Immediately after producing the drive motor energizing signal, the system scans the proximity sensors to determine whether or not there is a storage unit located in the selected proximity to the unit to be moved. As soon as the proximity sensors detect an adjacent unit and change states in response thereto, this is detected and the drive motors associated with the unit being moved are immediately de-energized.

Thus, in accordance with the present invention, there is provided a movable storage system in which a plurality of storage units may be selectively moved to open a desired access passage or aisle between a selected pair of storage units. This system allows for a maximum utilization of space in that only a single aisle is open at any one time with the other storage units abutted one against the other.

Numerous other advantages and features of the present invention will become readily apparent from the following detailed description of the invention and of one embodiment thereof, from the claims and from the accompanying drawing in which each and every detail shown is fully and completely disclosed as a part of this specification and in which like numerals refer to like parts.

BRIEF DESCRIPTION OF THE DRAWING

FIG. 1 is a partial perspective view of a storage system incorporating the present invention;

FIG. 2 is a somewhat diagrammatic front view of the storage system;

DETAILED DESCRIPTION OF PREFERRED EMBODIMENT

Figure 3:
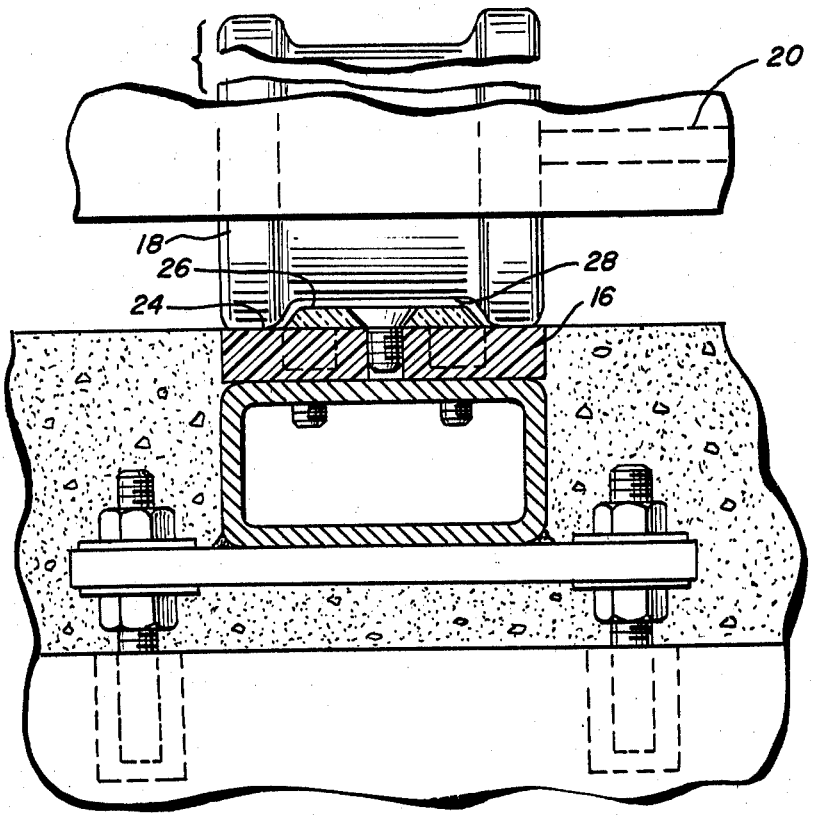
FIG. 3 is a detail view, partially in section, showing typical drive wheels and a support and guide rail for the storage system.

While this invention is susceptible of embodiment in many different forms, there is shown in the drawing and will herein be described in detail one specific embodiment, with the understanding that the present disclosure is to be considered as an exemplification of the principles of the invention and is not intended to limit the invention to the embodiment illustrated. The scope of the invention will be pointed our in the appended claims.

Referring now to FIGS. 1, 2 and 3 of the drawing, there is shown a movable storage system 10 having a plurality of storage units, including movable storage units or ranges 12, shown as two-sided bookshelves, and stationary storage units or ranges 14. In the drawing, the storage system shown includes ten movable shelf ranges 12 and a pair of stationary ranges 14 at either end. The movable ranges 12 are double-faced or two-sided to permit access from either face while the stationary ranges 14 are single-sided or single-faced and have access only from the one side facing towards the adjacent movable ranges.

The movable ranges 12 are supported on at least a pair of tracks or guide rails 16 (only one being shown) by appropriate drive and guide wheel assemblies 18 which are interconnected by a drive shaft 20 connected to a reversible drive motor 22. The drive motor 22 turns the drive wheels in either direction to effect movement of its range 12.

The movable shelf ranges 12 are reciprocally movable in a direction generally perpendicular to their faces along the guide rails 16 on which they are supported. Typically, as shown in FIG. 3, the guide rails 16 disposed closest to the opposite ends of each movable range 12 include a generally flat planar support surface 24 on which the drive wheels 18 rest. In the center of each of these guide rails 16 there is a raised guide bar 26. The recessed center portion 28 of the drive wheels or rollers 18 has a shape complementary to and which traverses the guide bar 26 to insure that the ranges track evenly along the support or guiderails 16.

The opposite ends of the ranges or storage units 12, 14, are provided with an optical or other suitable safety sensor 30. As shown, a light beam is directed from one unit to a next adjacent unit at each end. In addition, one or more mechanical safety sensors are provided in the form of elongated strip switches 32 traversing the exposed edges of selected shelves of each unit. The purpose and use of the safety sensors will be explained below.

A pair of reset or enabling switches 36 are disposed on both of the end panels 34 of each movable range 12. Only one enabling switch, however, is located on the end panels of the stationary ranges 14. The enabling switches 36 are located adjacent to the edges of the end panels. The enabling switches 36 must be actuated, as explained below, in order to permit selection of a new access path or open aisle and subsequant movement of the storage units. A selection switch 38 is also located on both of the end panels 34 of each of the movable ranges 12, and on one of the end panels 35 of each stationary range 14. The selection switches are actuated, as explained below, in order to select the aisle or access passage to be opened.

Operation of the movable shelving system is controlled by a micro-processor 39 disposed at the top of one of the ranges and connected to the circuitry on each of the ranges through cabling 42 supported in an overhead wireway 44. The ends of the cables 42 extend from the wireway 44 to a range terminal box 46 on top of each storage unit 12, 14. In view of the limited movement of each storage unit or range 12, the portions of the cable 42 extending from the wireway 44 to the range terminal box 46 can be kept relatively short.

The micro-processor control system which totally controls operation and movement of the storage system eliminates substantial amounts of high voltage wiring, except for the power connections to each drive motor 22 and associated brake solenoid. Almost all other signals are computer low level voltage signals. All switches with which personnel may come into contact are low voltage switches as is the wiring to which there is any chance of exposure.

Figure 4:
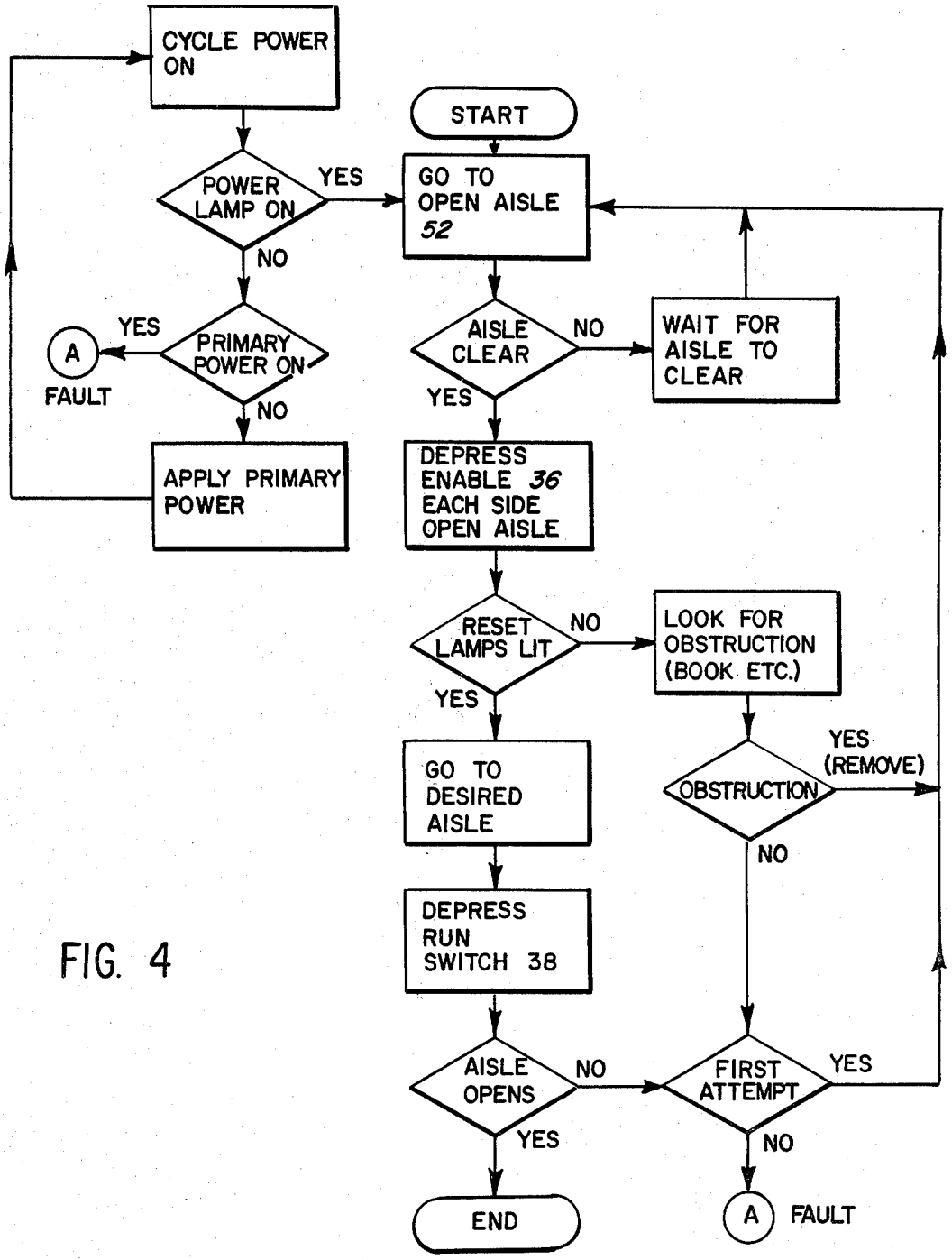
FIG. 4 is a flow chart illustrating the sequence of operations for utilizing the storage system.
Figure 5A:
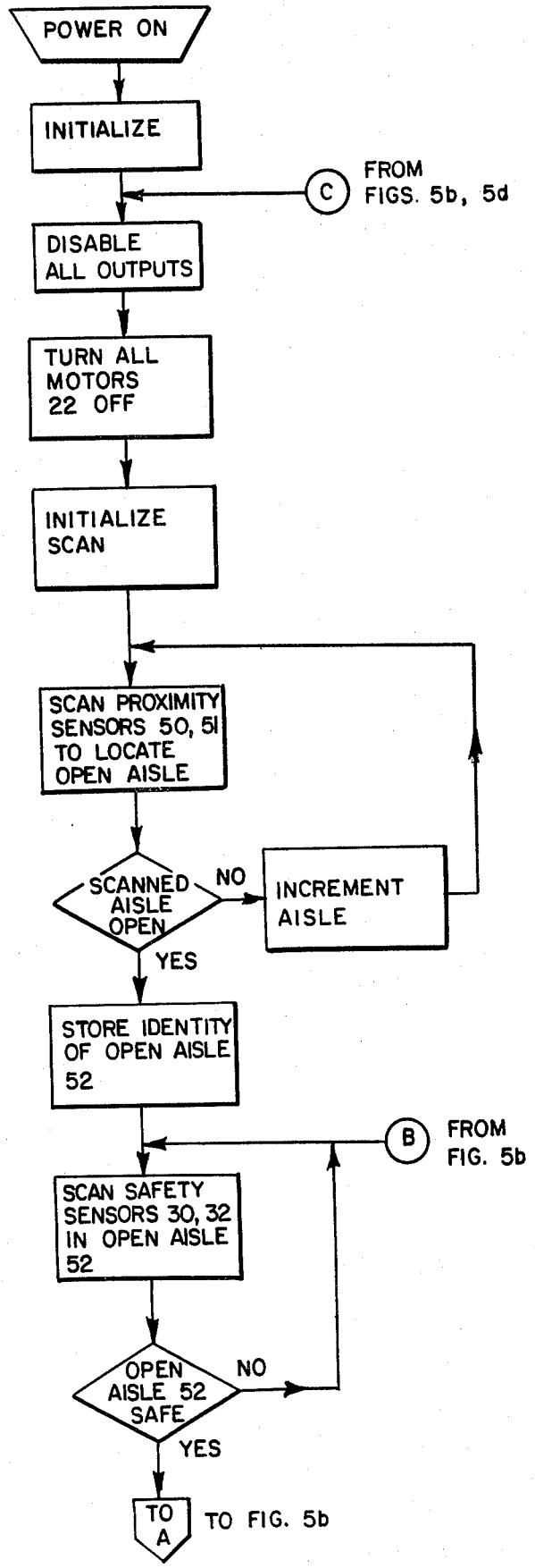
FIGS. 5*a* to 5*e* show an operational flow diagram for the control system for the storage system.
Figure 5B:
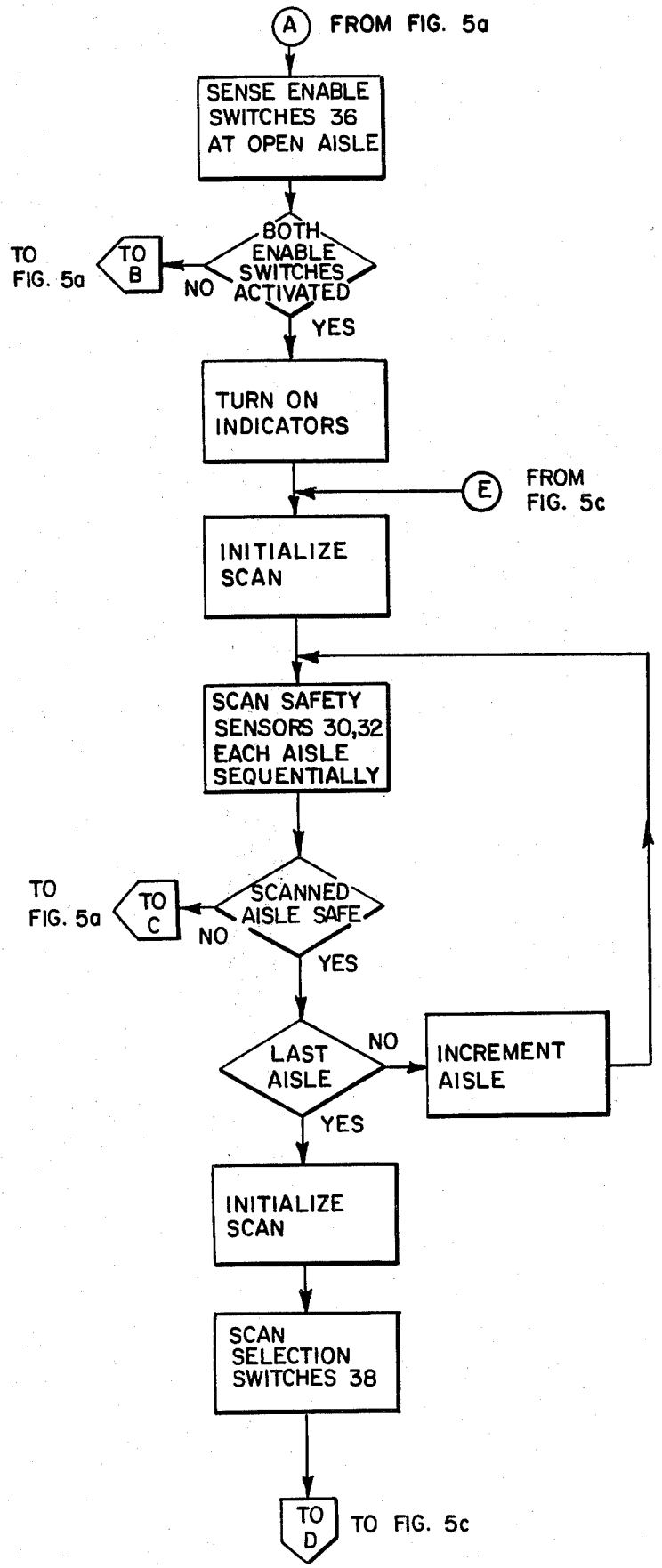
Figure 5C:
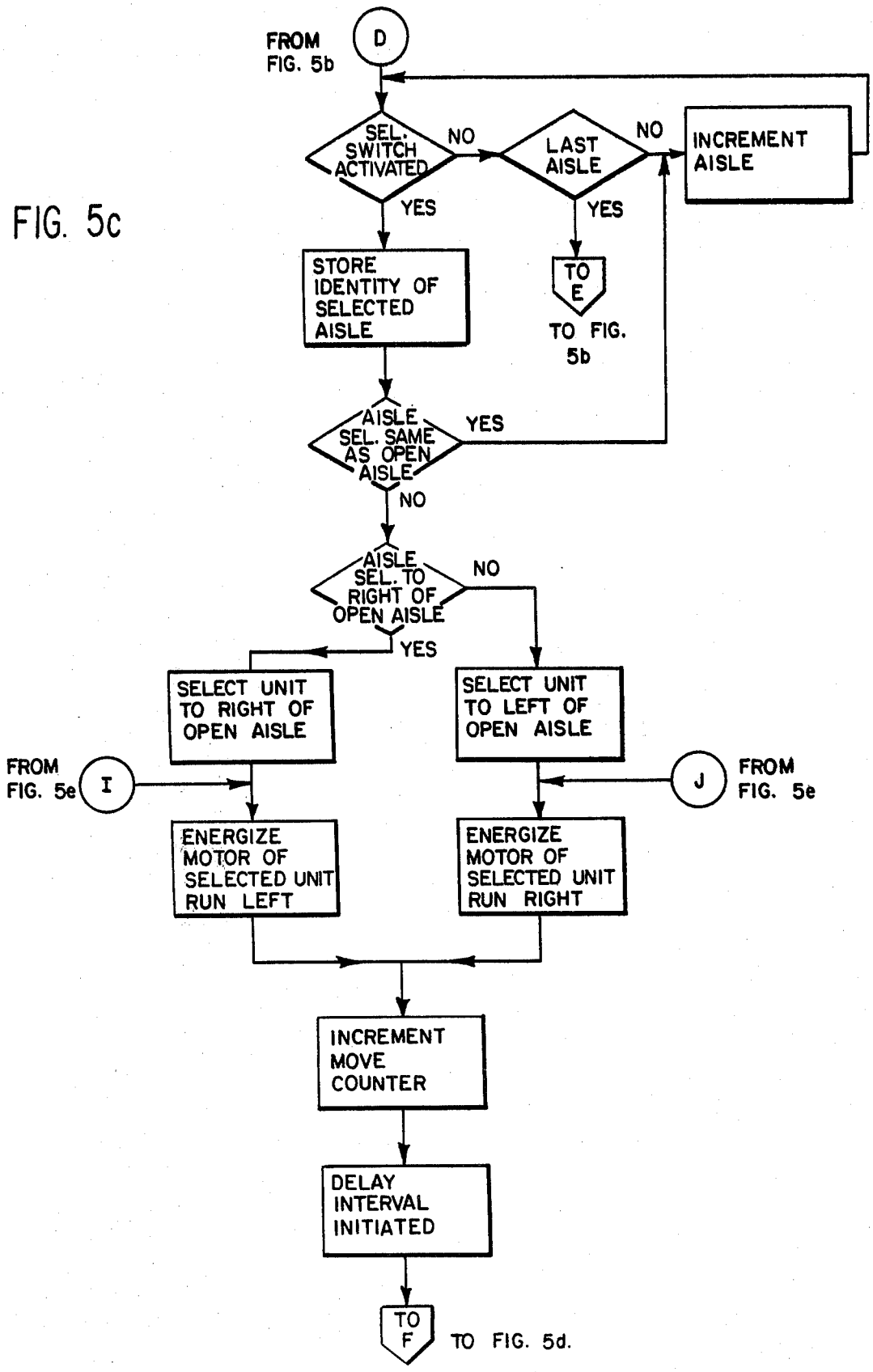
Figure 5D:
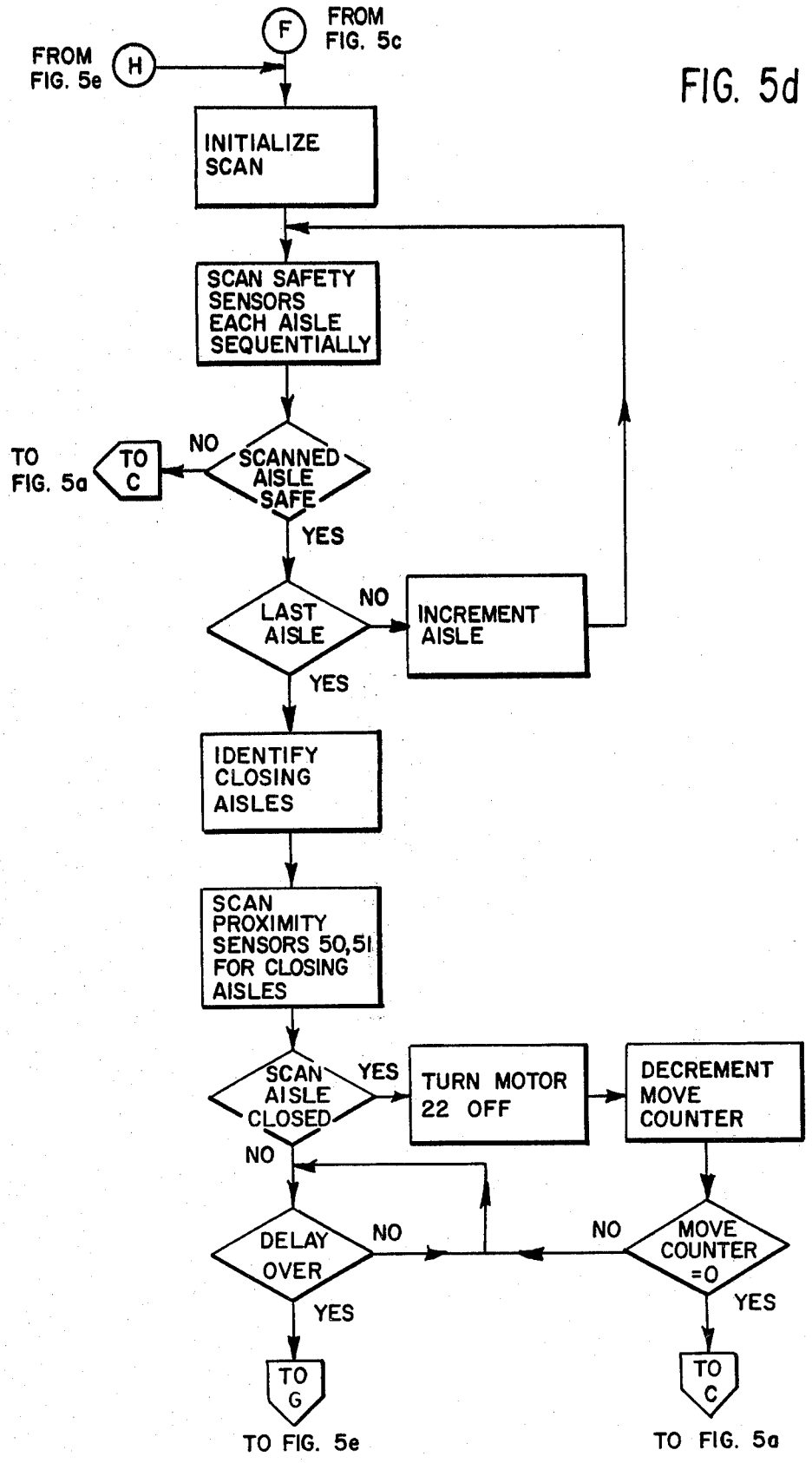
Figure 5E:
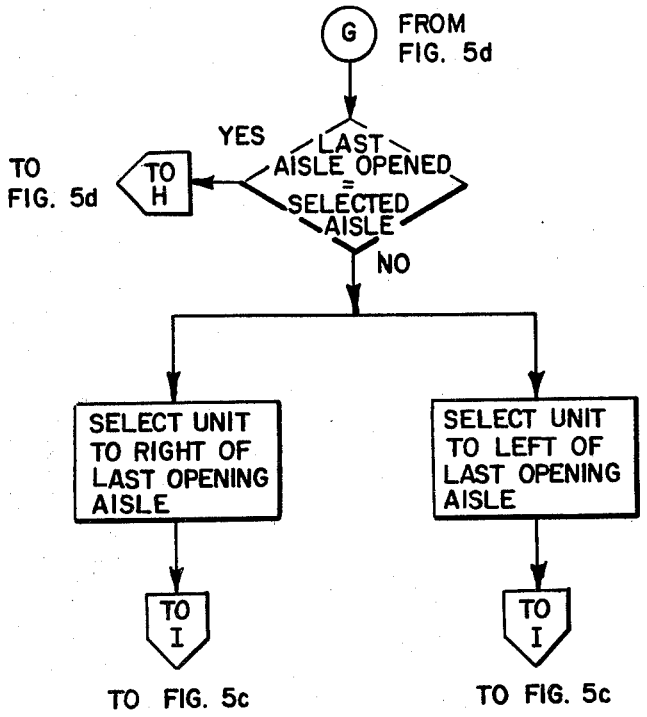

As illustrated in FIG. 4, once the power is on, the procedure for operating the storage system, i.e., for selecting a new open aisle or access passage, is quite simple. An operator must first go to the existing open aisle and observe that the aisle is clear. This is assured by the necessity to accuate both enabling switches 36 simultaneously which requires the operator to face the aisle as he reaches laterally for the enabling switches on the ranges on either side of the open aisle. When the aisle is clear, the operator depresses both of the enabling switches on the end panels of the ranges on either side of the open aisle. If everything is in order, appropriate indicators, e.g., lights, associated with the enabling switches, will be energized.

If the indicators do not light, an obstruction most likely exists. Once the obstruction is removed, or even if none is located, the operator actuates the two enabling switches once again.

After observing that the indicators have been energized, the operator goes to the desired aisle and actuates the appropriate selection or run switch 38 (usually to the right of the desired aisle). The necessary storage units move to close the existing aisle and open the selected aisle or access passage to provide the desired access to the faces of the storage units exposed to the newly created aisle.

Referring to FIGS. 5*a*–5*e*, when the power is initially applied to the control system, certain initializing steps are implemented. Thus, certain data, such as preset status switches, are scanned and stored in memory. The number of movable storage unit ranges being controlled and the delay timing associated with that number of ranges are examples of such data.

The next step in the control process, in order to assure safe operation, is to disable all control outputs and apply a motor off or motor de-energizing signal to each of the range drive motors. This is done to insure that none of the motors become energized when power is first applied to the system. This process is achieved by addressing the first movable range, applying a motor turn-off signal to the motor controller for that range drive motor. The control system increments and addresses each successive range and applies in turn the appropriate motor de-energizing signals.

The system then proceeds to scan the proximity sensors or limit switches 50, 51 for each pair of ranges the system looks for a matching pair, those facing each other, of open facing limit or proximity switches 50, 51 on adjacent ranges. Open proximity switches indicate that a space or gap exists between adjacent ranges thereby defining an open aisle or access passage. In operation, the system scans from one side of the storage system to the other to locate an open aisle. The first set of open proximity switches sensed is the aisle identified as the open aisle. That data is stored.

For purposes of illustration, the system will scan the ranges from left to right as shown in the drawing. Thus, the first pair of proximity switches scanned are the proximity switches 50 on the leftmost stationary range 14 and the facing proximity switches 51 on movable range 12 immediately to its right. If the facing switches 50, 51 associated with these two ranges are open, a space or aisle has been identified and the identity of this aisle is stored. If the switches are closed, the system increments to the next pair of ranges scanning the right proximity switches 50 of the left movable range of each pair and the left proximity switches 51 of the right range of each pair and determines whether that aisle is open.

When an open aisle 52 is identified, the identity of the aisle is stored. The system immediately scans the safety switches facing the open aisle, the optical switches 30 and the mechanical safety switches 32. If any of these switches is actuated, either by interruption of the optical or light beam or by depression of the mechanical safety switches, the system goes into a closed cycle of continuously scanning the safety switches, thereby precluding any other operation.

When the aisle is safe, i.e., none of the safety switches are actuated, the system scans the enabling switches associated with the storage unit ranges on either side of the open aisle. Thus, in the arrangement shown in the drawing, the system scans first the enabling switch 36 on the immediate left of the open aisle 52 and then scans the enabling switch 36 immediately to the right of the open aisle 52. If either of these two switches are not actuated, the system returns to check whether the aisle is safe and re-scans the switches in a continuing cycle.

When both enabling switches 36 are actuated and sensed by the system, indicators are energized to show that actuated enabling switches 36 have been sensed and that the system is now armed for selection of a new aisle or access passage. Initially, all the safety switches for each aisle are scanned sequentially. If an actuated safety switch 30, 32 is sensed, the system returns to the beginning of the cycle, de-activates all outputs and turns all motors off, as described above. If no safety switches are actuated, the system then scans the left to right for an actuated selection switch 38.

If all of the selection switches 38 have been scanned and none are actuated, the system returns to re-scan all of the safety switches 30, 32 sequentially and continues to scan the selection switches 38 until an actuated selection switch 38 is detected. When an actuated selection switch 38 is detected, the system stores the identity of the aisle selected and compares the identity of that aisle with the identity of the open aisle. If the aisle selected is the same as the current open aisle, the system ignores the actuated selection switch and continues to scan for an actuated selection switch which would operate to select a different aisle.

If the aisle selected is different from the current open aisle, the identities are compared to determine whether the selected aisle is to the right of the existing open aisle. If not, then the selected aisle is to the left of the open aisle. If to the left, for example, the system identifies the range immediately to the left of the current open aisle and produces a motor right signal to initiate movement of that range to the right. Once the motor is energized, the system increments a move counter which keeps track of the number of units in motion. A delay period is then initiated to preclude energizing the next range motor for a selected time interval. During the delay period all of the safety switches are scanned, as described above, to determine whether any are actuated and insure that no danger exists. If a safety switch is actuated then the system shuts down by returning to the beginning of the cycle and turning off all outputs and motors.

If no safety switch is actuated, the system checks the proximity switches in the direction of movement of the range being moved to insure that the shelf is not being moved when it is already adjacent to another range. If those proximity switches are closed, the motor for the range that has been energized is immediately deenergized. If the switches are open, the system then delays for the predetermined time period, checks to determine whether another range is to be moved, and re-initiates the motor energizing, delay and safety switch check cycle for each of the ranges to be moved.

Once the range which will open the selected aisle or access passage is moved, the system continues to scan the aisles between the moving ranges to determine when each range approaches another. When that occurs, as determined by actuation of proximity switches, the motor for that range is de-energized.

Each time a range drive motor is energized, the system increments a counter to keep track of the number of ranges being moved. Each time a drive motor is deenergized, upon sensing of a proximity sensor, the counter is decremented until such time as all of the drive motors that have been energized are de-energized. When all of the drive motors are de-energized, the system returns to the reset position, turning off all outputs and insuring that all motors are de-energized and renews the cycle by scanning for the new open aisle.

Thus there has been disclosed a multi-unit storage system in which a plurality of storage units are provided in minimum space by providing for only one access passage or aisle. In the storage system, the individual storage units or ranges are selectively moved when a new aisle is selected. The system incorporating the present invention provides a high degree of reliability, flexibility and safety by permitting a ready variation of operational sequences, by minimizing the complexity of wiring required, by minimizing the number of switches required, and by utilizing a minimal amount of high-voltage wiring. By initiating movement of the storage units at preselected time increments, movement of the storage units can be varied in accordance with the needs of a particular installation, e.g., in accordance with the number of movable storage units in a system, and selection of some access passages or movement of some storage units may even be restricted, if desired, except under special conditions, for example, by disabling corresponding switches.

From the foregoing, it will be observed that numerous variations and modifications may be effected without departing from the true spirit and scope of the novel concept of the present invention. It is, of course, intended to cover by the appended claims all such modifications as fall within the scope of the claims.

What is claimed is:

1. A movable storage system comprising:

a plurality of storage units disposed side-by-side and movable relative to each other to selectively open access paths between selected pairs of units;

drive means associated with each unit energizable to move said unit in a selected direction;

means for sensing the position of each storage unit relative to the adjacent storage units;

manually operable means for selecting an access path to be opened between a pair of storage units; and central control means coupled to each of said units and responsive to operation of said manually operable selecting means for identifying the units to be moved in order to open said selected access path, for determining the direction of said unit movement and for sequentially energizing said drive means associated with the units to be moved in a determined time delay sequence to sequentially initiate movement of each of said units and opening of the selected access path.

2. A storage system as claimed in claim 1 wherein:

each of said storage units is movable between a position immediately adjacent to a next adjacent storage unit and a position spaced apart from said next adjacent unit wherein an existing access path is defined therebetween; and said manually operable selecting means includes first switch means disposed on the pair of storage units defining said existing access path;

said central control means being responsive to simultaneous operation of said first switch means for enabling selection of a new access path.

3. A storage system as claimed in claim 2 including:

safety sensing means on said pair of storage units defining said existing access path for sensing the presence of any foreign object in said existing access path between said pair of storage units and being actuated in response thereto;

said central control means repetitively scanning and sensing the status of said safety sensing means and responsive to actuation thereof for disabling any response to actuation of said first switch means to preclude movement of any storage units until said safety sensing means is deactuated.

4. A storage system as claimed in claim 2 including:

safety sensing means on each of said storage units for sensing the presence of any foreign object in between any of said storage units and being actuated in response thereto;

said central control means repetitively scanning and sensing the status of said safety sensing means and responsive to actuation thereof subsequent to actuation of said first switch means for disabling selection of said new access path until said safety sensing means is deactuated.

5. A storage system as claimed in claims 2, 3 or 4 including:

second switch means located on a storage unit adjacent to each of the possible access paths to be selected;

said central control means sensing and being responsive to actuation of said second switch means only subsequent to a simultaneous actuation of a pair of first switch means for effecting movement of the storage units necessary to open the selected new access path.

6. A storage system as claimed in claim 5 including:

means on each of said storage units actuated in response to each of said moving units reaching a position in proximity to a next adjacent storage unit;

said central control means sensing and being responsive to said actuation of said proximity sensing means for de-energizing said drive means for said moving unit.

7. A storage system as claimed in claim 1 including:

safety sensing means on each of said storage units for sensing the presence of any foreign object in an access path between a pair of storage units and being actuated in response thereto;

said central control means sensing the status of said safety sensing means, and being responsive to actuation of said safety sensing means for de-actuating said manually operable selection means and for de-energizing any previously energized drive means.

8. A storage system as claimed in claim 7 wherein:

said central control means scans and senses the status of said safety sensing means repetitively and precludes movement of said storage units in response to actuation of any of said safety sensing means scanned.

9. A storage system as claimed in claim 1 wherein:

said central control means is responsive to actuation of said manual selecting means for initially energizing the drive means of the first storage unit to be moved and for sequentially energizing the drive means of subsequent storage units to be moved selected time intervals thereafter.

10. A movable storage system comprising:

a plurality of storage units disposed side-by-side and movable relative to each other to selectively open access paths between selected pairs of units;

drive means associated with each unit energizable to move said unit in a selected direction;

means for sensing the position of each storage unit relative to the adjacent storage units;

manually actuatable means for selecting an access path to be opened between a pair of storage units;

safety sensing means on each of said storage units for sensing the presence of any foreign object in an access path between a pair of storage units and being actuated in response thereto; and central control means coupled to each of said units and for sensing the status of and being responsive to actuation of said manually actuatable selecting means for identifying the units to be moved in order to open said selected access path, for determining the direction of said unit movement and for sequentially energizing said drive means associated with the units to be moved in a determined time delay sequence to sequentially initiate movement of each of said units and opening of the selected access path, said central control means sensing the status of and being responsive to actuation of said safety sensing means for disabling any response to said actuated manually actuatable selection means and for de-energizing any previously energized drive means.

11. A storage system as claimed in claim 10 wherein: said central control means scans said safety sensing means repetitively and precludes movement of said storage units in response to actuation of any of said safety sensing means scanned.

12. A storage system as claimed in claim 10 wherein: said central control means is responsive to actuation of said manually actuatable selecting means for initially energizing the drive means of the first storage unit to be moved and for sequentially energizing the drive means of subsequent storage units to be moved selected time intervals thereafter.

13. A movable storage system comprising:

a plurality of storage units disposed side-by-side and movable relative to each other to selectively open access paths between selected pairs of units;

drive means associated with each unit energizable to move said unit in a selected direction;

means for sensing the position of each storage unit relative to the adjacent storage units;

manually operable means for selecting a new access path to be opened between a pair of storage units including first switch means disposed on the pair of storage units defining an existing access path and second switch means located on a storage unit adjacent to each of the possible new access paths to be selected;

safety sensing means on each of said storage units for sensing the presence of any foreign object in an access path between a pair of storage units and being actuated in response thereto; and central control means coupled to each of said units and for sensing the status of and being responsive to simultaneous operation of said first switch means on said pair of storage units for enabling selection of said new access path and for sensing the status of and being responsive to actuation of one of said second switch means only subsequent to a simultaneous actuation of said pair of first switch means for identifying the units to be moved in order to open said selected new access path, for determining the direction of said unit movement and for sequentially energizing said drive means associated with the units to be moved in a determined time delay sequence to sequentially initiate movement of each of said units and opening of the selected new access path, said control means sensing the status of and being responsive to actuation of said safety sensing means prior to actuation of said second switch means for disabling any response to actuation of said first switch means to preclude movement of said units.

14. A storage system as claimed in claim 13 wherein: said central control means is responsive to actuation of said safety sensing means subsequent to actuation of said second switch means for de-energizing any energized drive means and for precluding subsequent energization of any additional drive means.

15. A storage system as claimed in claim 13 wherein: said manually operable means for selecting an access path to be open includes first switch means disposed on each pair of storage units;

said central control means being responsive to actuation of said second switch means only in response to prior actuation of said pair of first switch means disposed on the pair of storage units defining an existing access path.

16. A storage system as claimed in claim 15 wherein: said central control means sequentially senses each of said second switch means in response to the sensed prior simultaneous actuation of said pair of first switch means;

said central control means alternatively scanning all of said second switch means and said safety sensing means on each of said storage units until one of said safety sensing means or one of said second switch means is actuated.

17. A storage system as claimed in claim 15 including: means on each of said storage units actuated in response to an adjacent unit reaching a position in proximity to a next adjacent storage unit;

said central control means sensing said safety sensing means and selected ones of said proximity sensing means subsequent to energization of each of said drive means to be energized and prior to energization of the next drive means to be energized for de-energizing appropriate ones of said drive means in response to actuation of said proximity sensing means and for de-energizing all of said drive means in response to sensing of any of selected ones of said safety sensing means.

* * * * *